US010207522B2

(12) United States Patent
Mashima

(10) Patent No.: US 10,207,522 B2
(45) Date of Patent: Feb. 19, 2019

(54) PRINTING APPARATUS AND METHOD OF MOVING MEDIUM SUPPORT UNIT

(71) Applicant: SEIKO EPSON CORPORATION, Tokyo (JP)

(72) Inventor: Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/342,523

(22) Filed: Nov. 3, 2016

(65) Prior Publication Data

US 2017/0129262 A1 May 11, 2017

(30) Foreign Application Priority Data

Nov. 11, 2015 (JP) ..... 2015-221210

(51) Int. Cl.

| | |
|---|---|
| ***B41J 11/06*** | (2006.01) |
| ***B41J 11/14*** | (2006.01) |
| ***B41J 11/58*** | (2006.01) |
| ***B41J 3/407*** | (2006.01) |
| ***B41J 29/02*** | (2006.01) |
| ***B41J 29/13*** | (2006.01) |

(52) U.S. Cl.

CPC ..... *B41J 11/58* (2013.01); *B41J 3/4078* (2013.01); *B41J 11/06* (2013.01); *B41J 11/14* (2013.01); *B41J 29/023* (2013.01); *B41J 29/13* (2013.01)

(58) Field of Classification Search

CPC . B41J 3/4078; B41J 11/06; B41J 11/14; B41J 11/58

See application file for complete search history.

(56) References Cited

U.S. PATENT DOCUMENTS

| | | | | |
|---|---|---|---|---|
| 6,095,628 | A | 8/2000 | Rhome | |
| 2004/0179081 | A1* | 9/2004 | Nimi | B41J 2/01 347/104 |
| 2006/0152568 | A1 | 7/2006 | Niimi et al. | |
| 2006/0203069 | A1 | 9/2006 | Niimi et al. | |
| 2013/0278697 | A1 | 10/2013 | Takeuchi et al. | |
| 2013/0278698 | A1 | 10/2013 | Takeuchi et al. | |

FOREIGN PATENT DOCUMENTS

| | | | |
|---|---|---|---|
| JP | 2004-276319 | A | 10/2004 |
| JP | 2004-291399 | A | 10/2004 |
| JP | 2013-043386 | A | 3/2013 |
| JP | 2013-227089 | A | 11/2013 |

OTHER PUBLICATIONS

European Search Report for Application No. 16197591.7 dated Apr. 6, 2017.

* cited by examiner

*Primary Examiner* — Kristal Feggins
*Assistant Examiner* — Kendrick Liu
(74) *Attorney, Agent, or Firm* — Workman Nydegger

(57) ABSTRACT

A printing apparatus includes a base unit that can move in a moving direction and a medium support unit that supports a medium on which printing will be performed and moves in the moving direction along with the base unit by being attached to the base unit. When a position of the medium support unit with respect to the base unit during printing is defined as a base position, the medium support unit is slidable with respect to the base unit from the base position in the moving direction. By employing such a configuration, it is possible to suppress deterioration of work efficiency when setting a medium.

9 Claims, 10 Drawing Sheets

PRINTING APPARATUS AND METHOD OF MOVING MEDIUM SUPPORT UNIT

BACKGROUND

1. Technical Field

The present invention relates to a printing apparatus and a method of moving a medium support unit.

2. Related Art

In related art, various printing apparatuses have been used. Among such printing apparatuses, many printing apparatuses are used which include a medium support unit that moves while supporting a medium on which printing will be performed.

For example, JP-A-2004-291399 discloses an ink jet cloth printing apparatus including a medium support unit (a first platen) that moves while supporting a medium (a T-shirt) on which printing will be performed.

However, in a related art printing apparatus including a medium support unit that moves while supporting a medium, when setting a medium to the medium support unit, work efficiency may deteriorate. This is because a moving range of the medium support unit with respect to a housing unit of the printing apparatus is limited and a part of the medium support unit may be located inside the housing unit when setting a medium. On the other hand, if the moving range of the medium support unit is increased in order to prevent a part of the medium support unit from being located inside the housing unit when setting a medium, the apparatus is enlarged in a related art configuration.

In the ink jet cloth printing apparatus of JP-A-2004-291399, a part of a first platen is located inside the housing unit when setting a medium, so that it is not possible to suppress deterioration of work efficiency when setting a medium to the medium support unit.

SUMMARY

An advantage of some aspects of the invention is to suppress deterioration of work efficiency when setting a medium.

A printing apparatus according to a first aspect of the invention includes a base unit that can move in a moving direction and a medium support unit that supports a medium on which printing will be performed and moves in the moving direction along with the base unit by being attached to the base unit. When a position of the medium support unit with respect to the base unit during printing is defined as a base position, the medium support unit is slidable with respect to the base unit from the base position in the moving direction.

According to this aspect, when a position of the medium support unit with respect to the base unit during printing is defined as a base position, the medium support unit is slidable with respect to the base unit from the base position in the moving direction. In other words, the medium support unit is moved with respect to the base unit in the moving direction, so that the medium support unit can be moved from the base position that is a position during printing to a setting position that is a position of when the medium is set. In other words, it is possible to move (draw out) the medium support unit to outside of a housing unit so that the medium support unit is not located inside the housing unit by moving the medium support unit with respect to the base unit in the moving direction when setting a medium. Therefore, it is possible to suppress deterioration of work efficiency when setting a medium.

In the first aspect, a printing apparatus according to a second aspect of the invention includes a printing unit that can print an image on the medium and a housing unit that houses the printing unit and has an opening portion through which the medium support unit can move forward and backward on one side of the moving direction. When the medium support unit is located at the base position in a state in which the base unit is moved most to the one side, at least a part of the medium support unit is located inside the housing unit with respect to the opening portion.

According to this aspect, when the medium support unit is located at the base position in a state in which the base unit is moved most to the one side, at least a part of the medium support unit is located inside the housing unit with respect to the opening portion. Specifically, it is possible to suppress enlargement of the apparatus by reducing the moving range of the base unit and further it is possible to move the medium support unit to the outside of the housing unit so that the medium support unit is not located inside the housing unit by moving the medium support unit with respect to the base unit in the moving direction in a state in which the base unit is moved most to the one side. Therefore, it is possible to suppress deterioration of work efficiency when setting a medium.

Here, "has an opening portion . . . on one side of the moving direction" has a meaning of having an opening portion at least on one side of the moving direction, and has a meaning of two cases including a case in which the opening portion is included only on one side of the moving direction and a case in which the opening portion is included on both sides of the moving direction.

In the second aspect, a printing apparatus according to a third aspect of the invention is characterized in that when the medium support unit is slid from the base position in a state in which the base unit is moved most to the one side, a part that is located inside the housing unit is exposed to the outside of the housing unit.

According to this aspect, when the medium support unit is slid from the base position in a state in which the base unit is moved most to the one side, a part that is located inside the housing unit is exposed to the outside of the housing unit. In other words, when the medium support unit is located at the setting position in a state in which the base unit is moved most to the one side, the medium support unit is located outside the housing unit with respect to the opening portion. Therefore, it is possible to suppress deterioration of work efficiency when setting a medium.

In the second and the third aspects, a printing apparatus according to a fourth aspect of the invention is characterized in that when the medium support unit is located at the base position in a state in which the base unit is moved most to the one side, at least a part of the medium support unit is located outside the housing unit with respect to the opening portion, and when the medium support unit is slid from the base position to the other side in a state in which the base unit is moved most to the one side, at least a part of the part that is located outside the housing unit is housed inside the housing unit.

According to this aspect, when the medium support unit is slid from the base position to the other side in a state in which the base unit is moved most to the one side, at least a part of the part that is located outside the housing unit is housed inside the housing unit. In other words, the medium support unit can move from the base position to a pushed-in position opposite to the setting position in the moving direction A. Therefore, by moving the medium support unit to the pushed-in position when the printing apparatus is not used, it is possible to prevent the medium support unit from being an obstacle. Further, by setting the pushed-in position so that the medium support unit is positioned inside the housing unit, it is possible to prevent the medium support unit from getting dirty.

In any one of the first to the fourth aspects, a printing apparatus according to a fifth aspect of the invention is characterized by including a fixing portion that fixes the medium support unit to the base unit at the base position.

According to this aspect, the fixing portion that fixes the medium support unit to the base unit at the base position is included. Therefore, it is possible to prevent printing precision from deteriorating due to movement (and vibration) of the medium support unit during printing.

In any one of the first to the fifth aspects, a printing apparatus according to a sixth aspect of the invention is characterized in that the medium support unit includes a holding portion that can be held when the medium support unit is moved with respect to the base unit in the moving direction.

According to this aspect, the medium support unit includes the holding portion that can be held when the medium support unit is moved with respect to the base unit in the moving direction. Therefore, it is possible to improve workability when moving the medium support unit with respect to the base unit in the moving direction.

A method of moving a medium support unit according to a seventh aspect of the invention is a method of moving a medium support unit in a printing apparatus including a base unit that can move in a moving direction and the medium support unit that supports a medium on which printing will be performed and moves in the moving direction along with the base unit by being attached to the base unit. The method causes the medium support unit to slide with respect to the base unit from a base position in the moving direction when a position of the medium support unit with respect to the base unit during printing is defined as the base position.

According to this aspect, when a position of the medium support unit with respect to the base unit during printing is defined as a base position, the medium support unit is slid with respect to the base unit from the base position in the moving direction. In other words, the medium support unit is moved with respect to the base unit in the moving direction, so that the medium support unit is moved from the base position which is a position during printing to a setting position that is a position of when the medium is set. In other words, it is possible to move (draw out) the medium support unit to outside of a housing unit so that the medium support unit is not located inside the housing unit by moving the medium support unit with respect to the base unit in the moving direction when setting a medium. Therefore, it is possible to suppress deterioration of work efficiency when setting a medium.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, a printing apparatus 1 according to an embodiment of the invention will be described in detail with reference to the accompanying drawings.

First, an overview of the printing apparatus 1 of the embodiment will be described.

Figure 1:
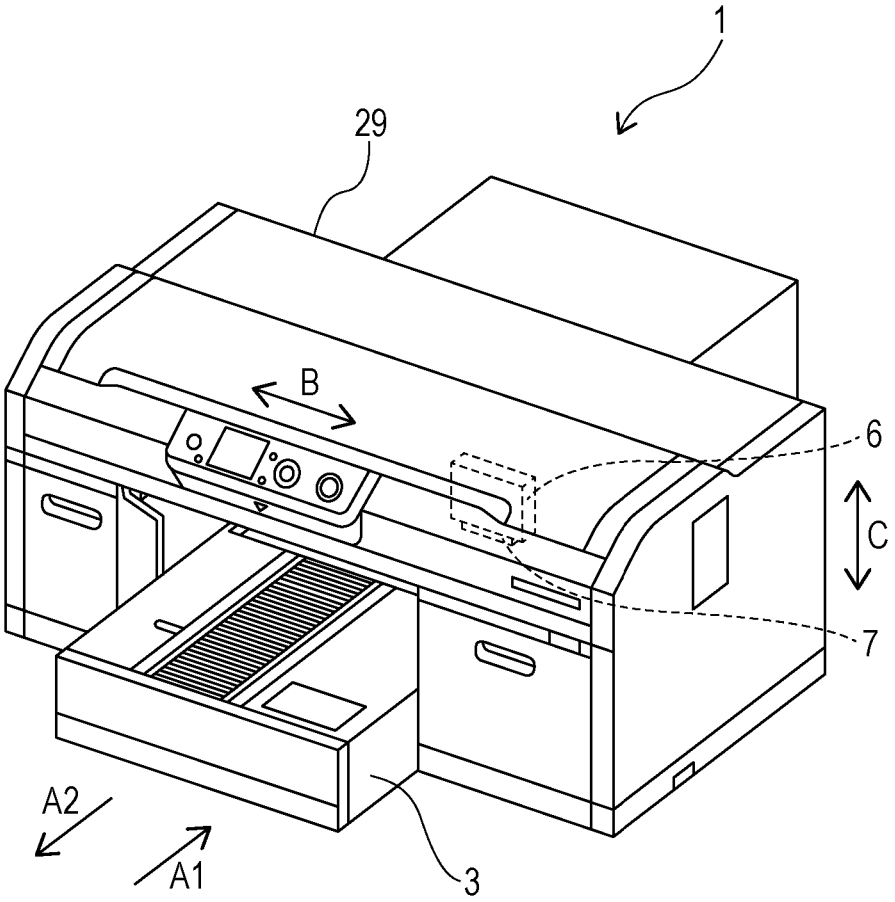
FIG. 1 is a schematic perspective view of a printing apparatus according to an embodiment of the invention.
Figure 2:
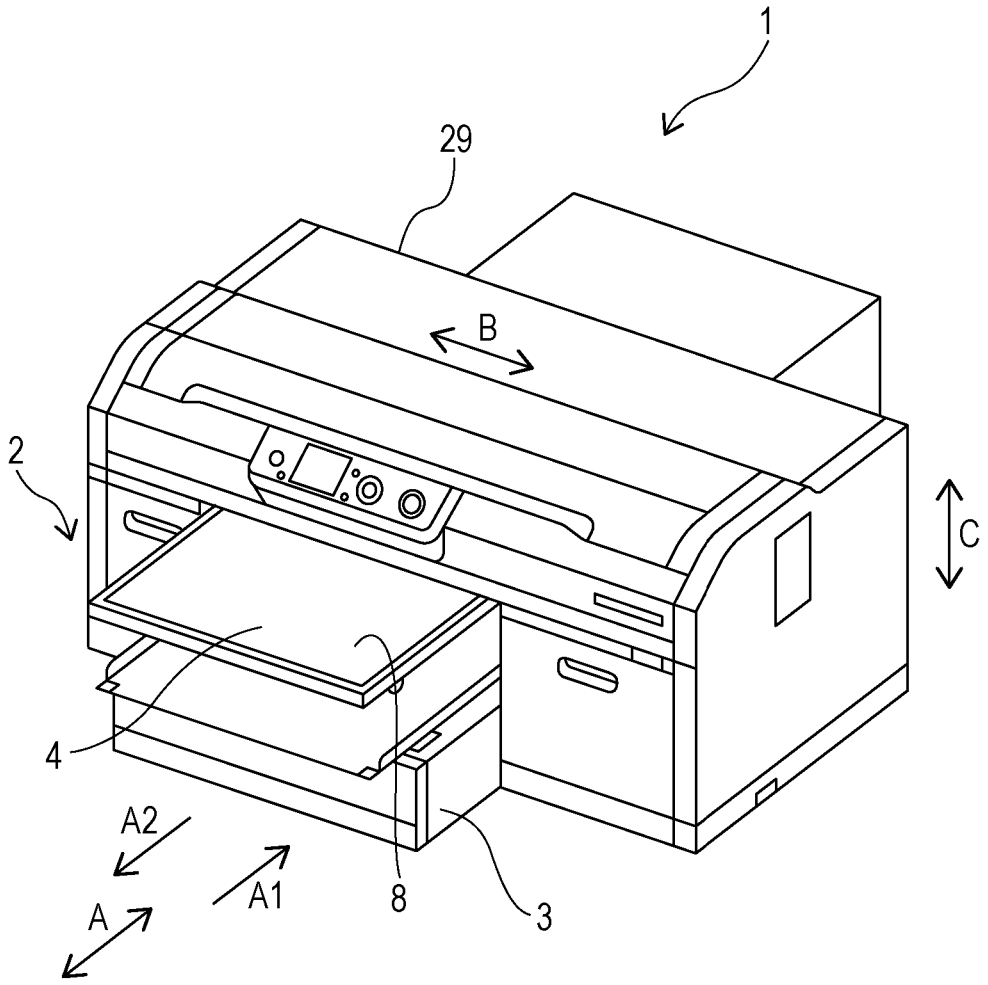
FIG. 2 is a schematic perspective view of the printing apparatus according to the embodiment of the invention.

FIGS. 1 and 2 are schematic perspective views of the printing apparatus 1 according to the embodiment. FIG. 1 shows a state in which a tray 4 that is a support unit (a medium support unit) of a medium (a medium on which printing is performed) of the printing apparatus 1 of the embodiment is located at a print start position. FIG. 2 shows a state in which the tray 4 is located at a print end position.

Figure 3:
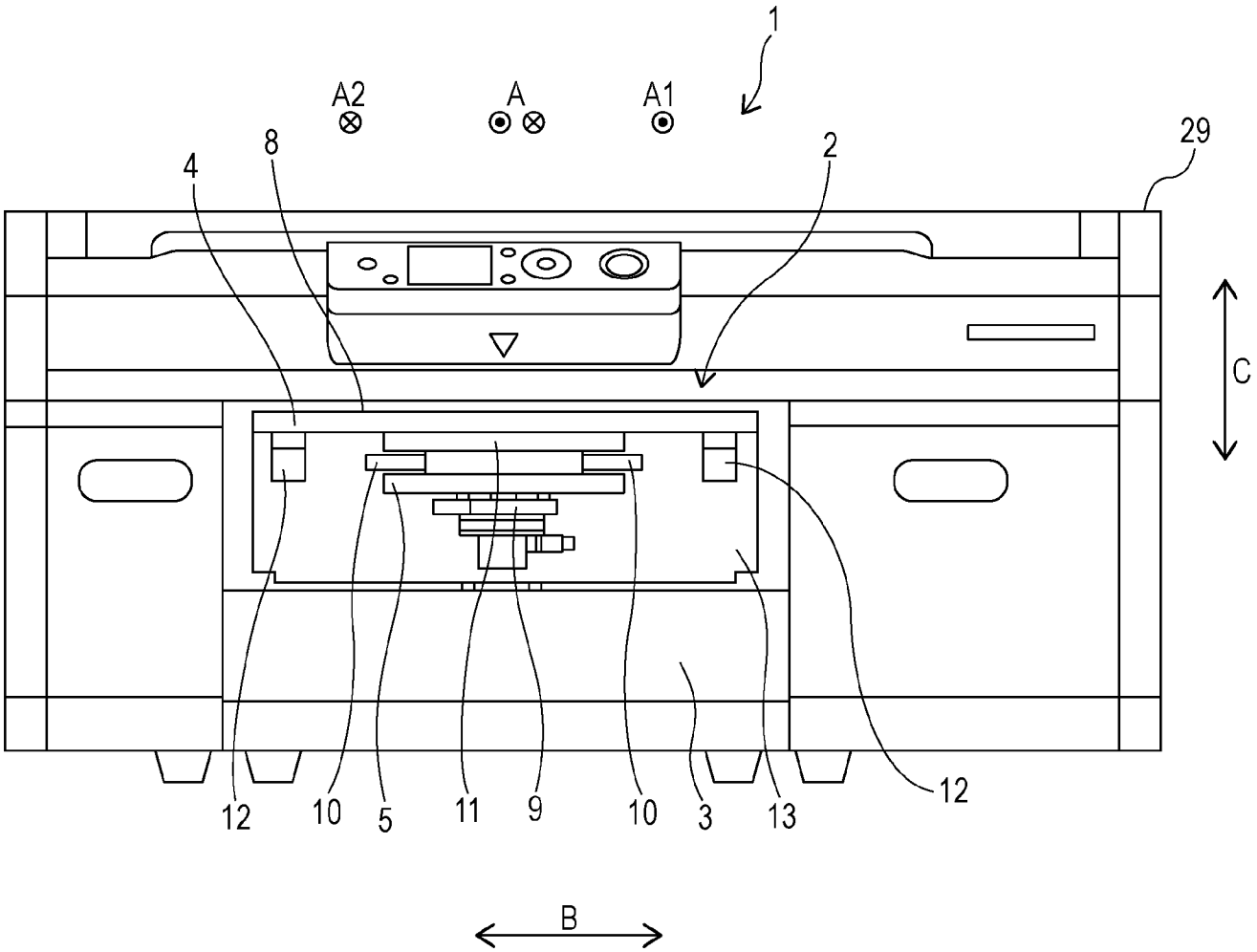
FIG. 3 is a schematic front view of the printing apparatus according to the embodiment of the invention.
Figure 4:
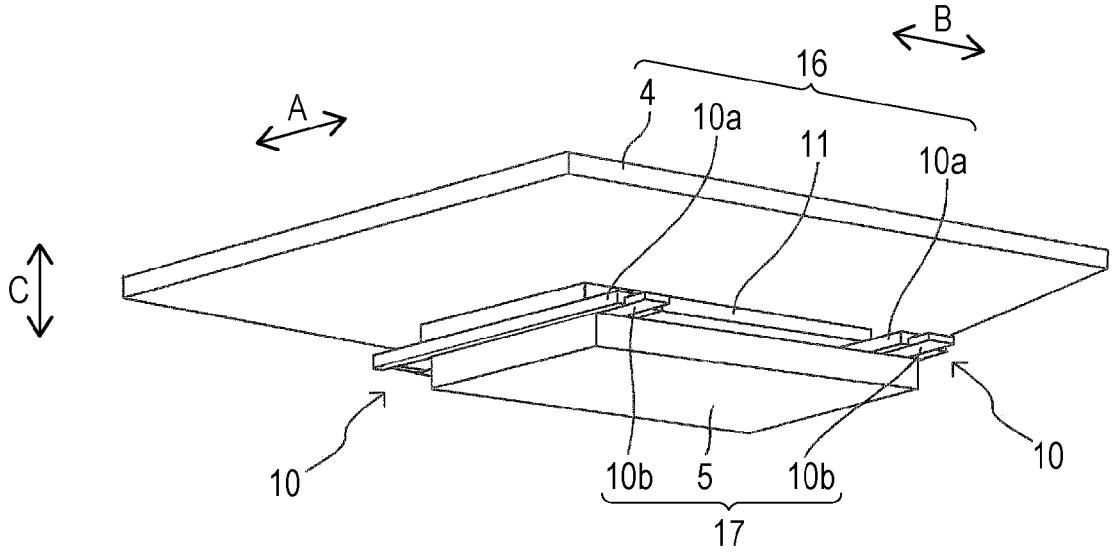
FIG. 4 is a schematic perspective view of a main part of the printing apparatus according to the embodiment of the invention.

FIG. 3 is a schematic front view of the printing apparatus 1 of the embodiment. FIG. 4 is a schematic perspective view showing a slide mechanism of the medium support unit (the tray 4) that is a main part of the printing apparatus 1 of the embodiment.

The printing apparatus 1 of the embodiment includes a medium support unit 2 that moves in a moving direction A in a state in which a support surface 8 of the tray 4 supports a medium. The medium support unit 2 has a tray 4 that is a support unit of a medium. The printing apparatus 1 includes a medium transport unit 3 that transports the medium supported by the tray 4 in the moving direction A. The moving direction A is directions including a direction A1 and a direction A2 opposite to the direction A1. Specifically, the tray 4 moves in the moving direction A by receiving a drive force of the medium transport unit 3 through a base unit 17 described later, so that the tray 4 can move forward and backward with respect to an opening portion 13 (see FIG. 3) provided in a housing unit 29.

As shown in FIGS. 3 and 4, the tray 4 is installed in a state of being fixed to an installation table 11 including upper rails 10*a* and the installation table 11 is mounted on a stage 5 including lower rails 10*b*. In other words, the tray 4 is mounted on the stage 5 through the installation table 11 and slide rails 10 including the upper rail 10*a* and the lower rail 10*b*. In this configuration, by sliding the upper rail 10*a* with respect to the lower rail 10*b*, it is possible to slide a moving unit 16 including the tray 4, the installation table 11, and the upper rail 10*a* along with the moving direction A with respect to the base unit 17 which has the stage 5 and the lower rail 10*b* and can move in the moving direction A by receiving the drive force of the medium transport unit 3.

In other words, the tray 4 (the moving unit 16) can move in the moving direction A along with the base unit 17 by the drive force of the medium transport unit 3 and also a user can move the tray 4 in the moving direction A with respect to the base unit 17 by holding the tray 4 and applying a force in the moving direction A. It is possible to represent that the medium support unit 2 is formed from the moving unit 16 and the base unit 17.

The base unit 17 further includes a rotating lever 9. When the rotating lever 9 is rotated, the tray 4 moves in the height direction C along with the stager 5. The rotating lever 9 is provided to an arm portion that is a member included in the base unit 17. As a medium, it is possible to use various materials such as textile (fabric, cloth, and the like), paper, and vinyl chloride resin.

Although omitted in FIG. 4, as shown in FIG. 3, leg portions 12 that come into contact with a floor surface when the tray 4 is removed from the installation table 11 are provided on a surface of the tray 4 opposite to the support surface 8.

A print head 7 that can discharge ink and perform printing on the medium is provided inside a main body of the printing apparatus 1. The printing apparatus 1 of the embodiment causes the print head 7 to discharge ink to the medium supported by the tray 4 and forms a desired image while reciprocating the print head 7 in a scanning direction B crossing the moving direction A by reciprocating a carriage 6 where the print head 7 is provided in the scanning direction B. In the embodiment, the carriage 6 including the print head 7 can move in the scanning direction B and corresponds to a printing unit that can print an image on the medium.

In the printing apparatus 1 of the embodiment, a position from which the medium is set into the tray 4 is located on the front side (lower left) of FIGS. 1 and 2. The tray 4 on which the medium is set is moved in the direction A1 of the moving direction A to a print start position located on the rear side (upper right) of FIGS. 1 and 2, and thereafter, printing is performed while the tray 4 is being moved in the direction A2 of the moving direction A. FIG. 1 corresponds to a position of the base unit 17 immediately before starting the print operation and FIG. 2 corresponds to a position of the base unit 17 immediately after completing the print operation.

As described above, a user can move the tray 4 (the moving unit 16) of the embodiment in the moving direction A with respect to the base unit 17 by applying a force to the tray 4. Here, the position (a movable range) of the tray 4 in a state in which the base unit 17 is moved to a front most position (in the direction A2: one of the moving directions A) in the printing apparatus 1 of the embodiment will be described.

Figure 5:
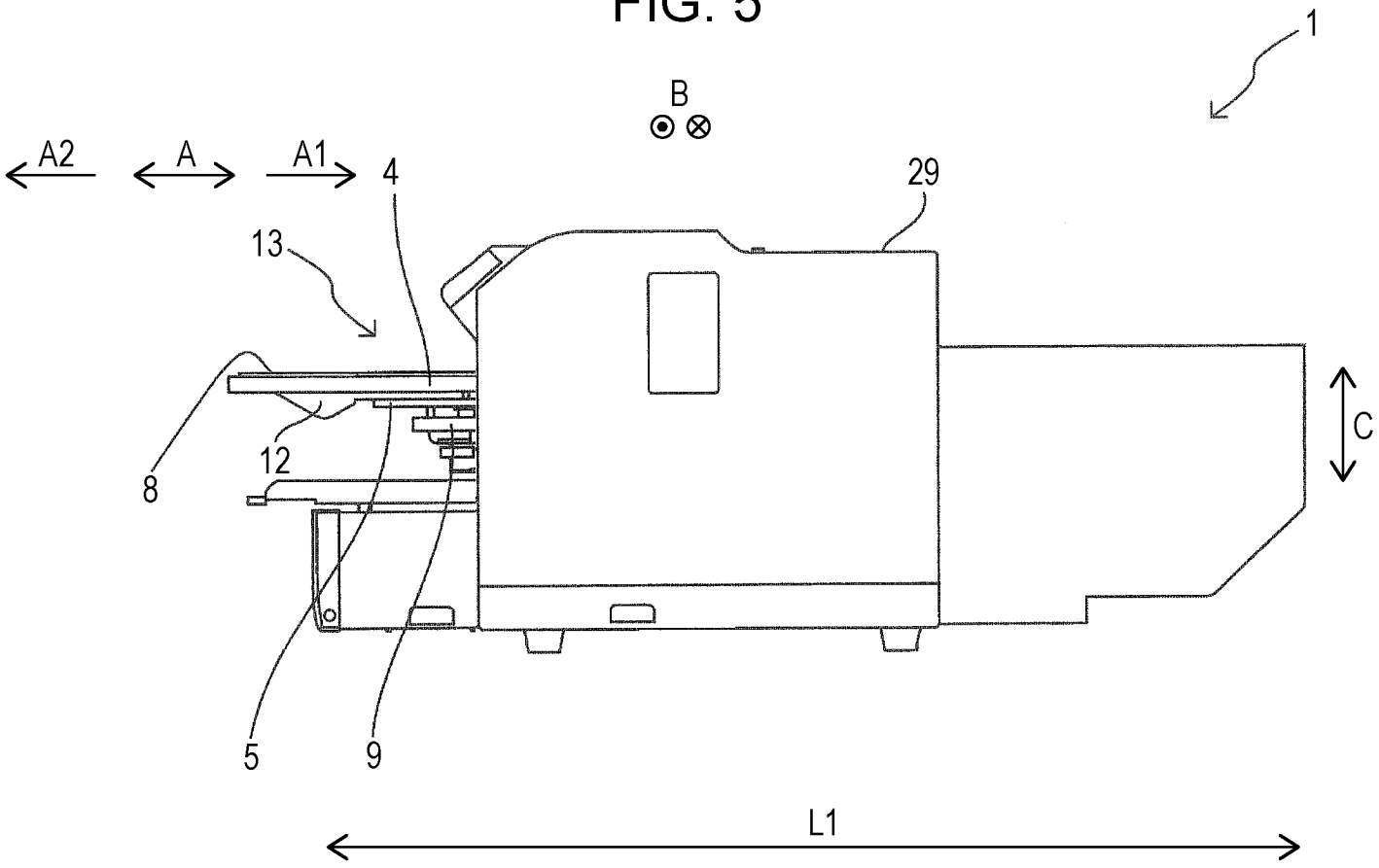
FIG. 5 is a schematic side view of the printing apparatus according to the embodiment of the invention.
Figure 6:
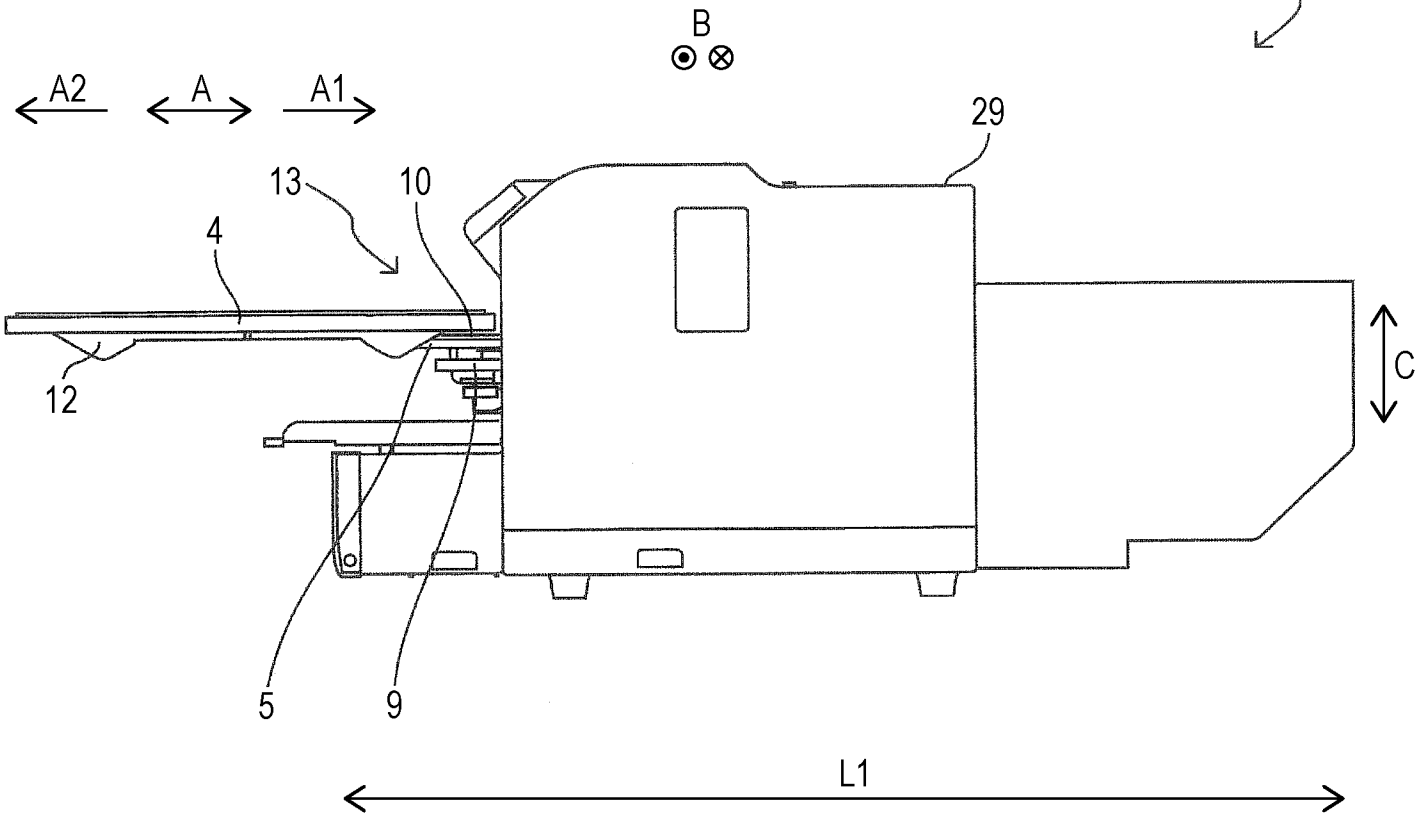
FIG. 6 is a schematic side view of the printing apparatus according to the embodiment of the invention.
Figure 7:
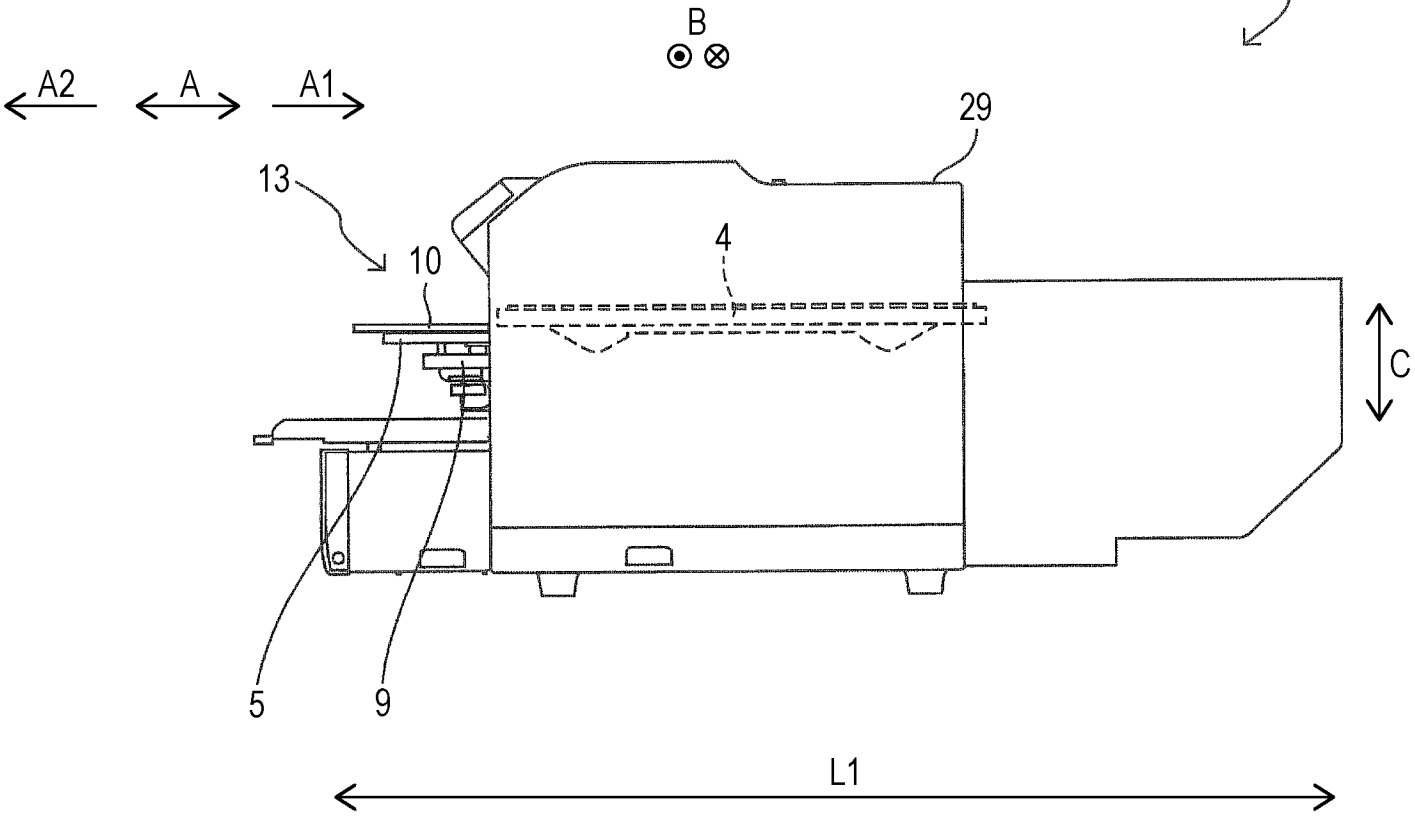
FIG. 7 is a schematic side view of the printing apparatus according to the embodiment of the invention.

FIGS. 5 to 7 are schematic side views of the printing apparatus 1 of the embodiment, which show different positions of the tray 4 (FIG. 5: base position, FIG. 6: setting position, FIG. 7: pushed-in position) in a state in which the base unit 17 is moved to the front most position.

Figure 10:
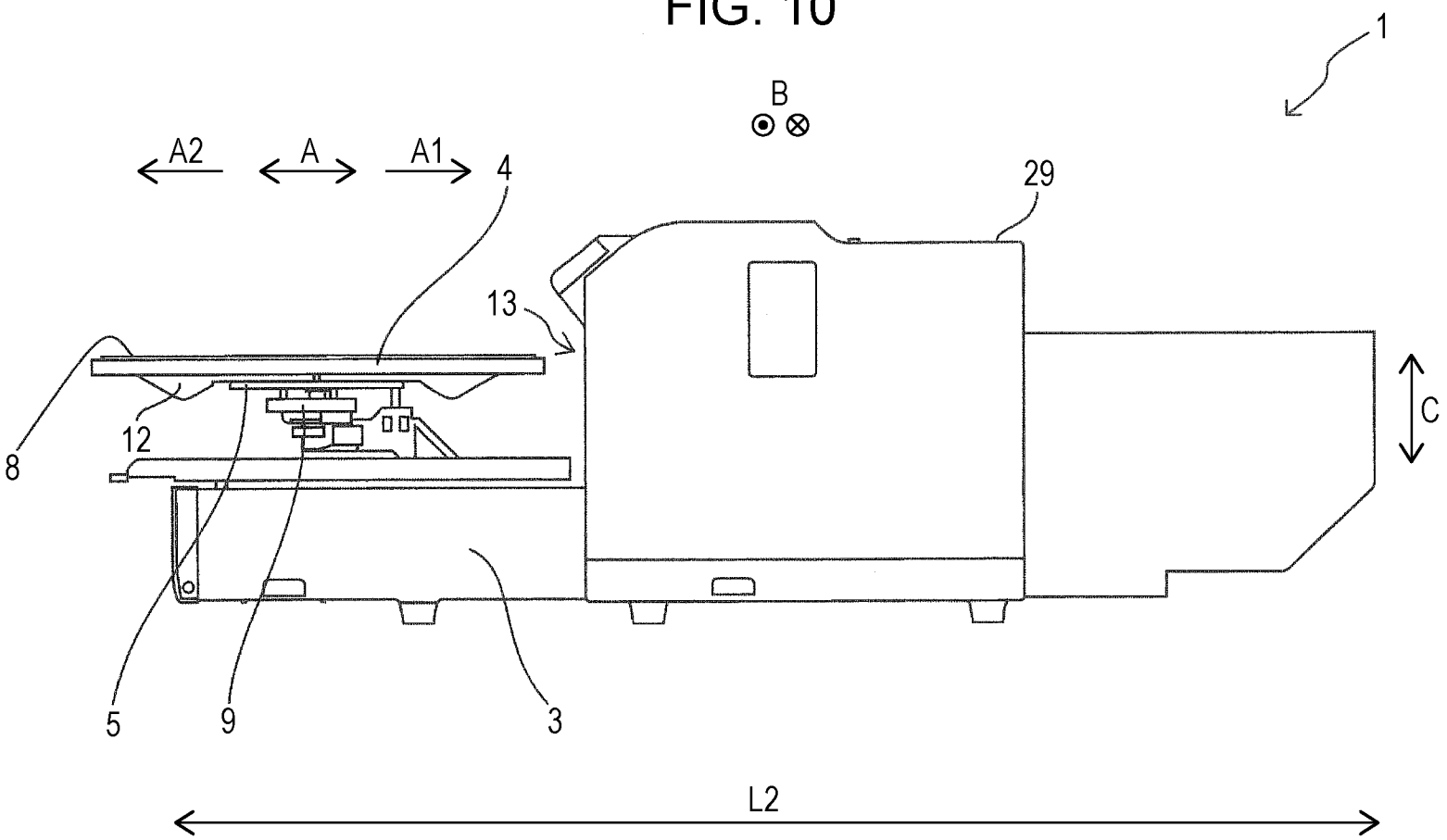
FIG. 10 is a schematic side view of a related art printing apparatus.

On the other hand, FIG. 10 is a schematic side view of an ordinary printing apparatus 1 of a related art, in which the tray 4 cannot move with respect to the base unit 17.

In the ordinary printing apparatus 1 of a related art, in which the tray 4 cannot move with respect to the base unit 17, as shown in FIG. 10, when setting a medium on the tray 4, if the tray 4 is located inside the housing unit 29 of the printing apparatus 1, workability decreases, so that the tray 4 is not located inside the housing unit 29 of the printing apparatus 1. Therefore, it is necessary to secure a long moving range of the tray 4 on the front side (in the direction A2), so that the depth length L2 of the printing apparatus 1 becomes long. Therefore, as an installation area of the printing apparatus 1, an installation area whose depth length is long corresponding to the depth length L2 of the printing apparatus 1 is required.

On the other hand, as shown in FIG. 5, the depth length L1 of the printing apparatus 1 of the embodiment is shorter than the depth length L2 of the printing apparatus 1 shown in FIG. 10. This is because, in the printing apparatus 1 of the embodiment, the tray 4 can be moved in the moving direction A with respect to the base unit 17, and when setting a medium, the tray 4 is moved from the base position shown in FIG. 5 to the setting position shown in FIG. 6, so that the tray 4 can be located not inside the housing unit 29 of the printing apparatus 1 while the depth length L1 is shortened.

Here, the position (the base position) of the tray 4 shown in FIG. 5 is a position with respect to the base unit 17 during printing. The position (the setting position) of the tray 4 shown in FIG. 6 is a position of when a medium is set (a position to which the tray 4 is slid from the base position in the direction A2).

The printing apparatus 1 of the embodiment has a configuration in which the tray 4 can be housed inside the housing unit 29 by moving the tray 4 from the base position shown in FIG. 5 to the pushed-in position shown in FIG. 7 (the tray 4 is slid from the base position to a position in the direction A1).

The printing apparatus 1 has a design in which suppression of enlargement of the printing apparatus 1 is prioritized by increasing the moving range of the tray 4 with respect to the base unit 17. However, the moving range of the tray 4 with respect to the base unit 17 may be set to, for example, a range in which the tray 4 does not move with respect to the base unit 17 beyond an area where the end of the tray 4 and the end of the stage 4 become flush with each other, and thereby it may be designed so that a medium is difficult to be drawn between the tray 4 and the stage 5 when the tray 4 is moved with respect to the base unit 17. A receiving unit that receives a medium that runs off the tray 4 may be provided below the tray 4 (between the tray 4 and the stage 5) so that the medium is difficult to be drawn between the tray 4 and the stage 5. A gap between the tray 4 and the stage 5 may be adjusted according to a medium to be used so that the medium is difficult to be drawn between the tray 4 and the stage 5.

Figure 8:
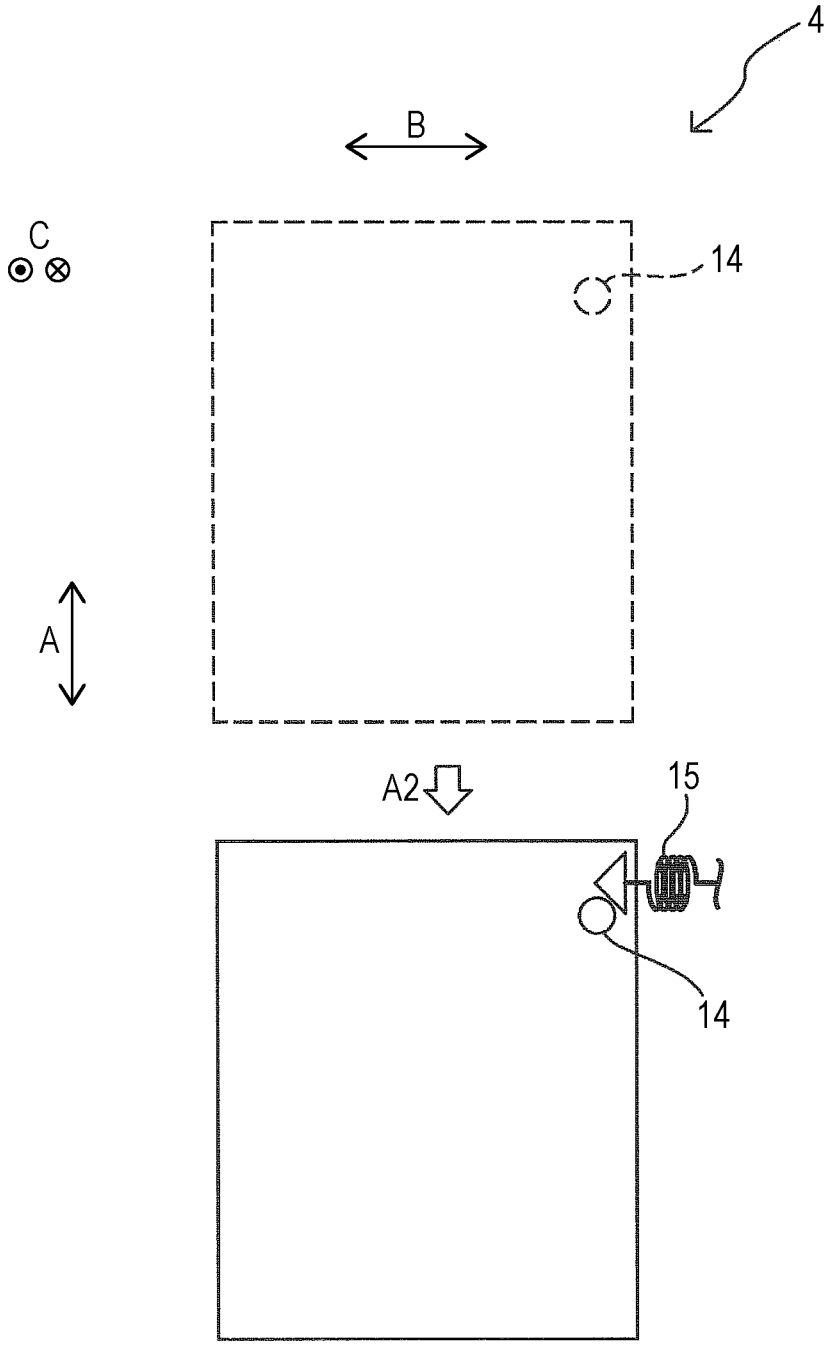
FIG. 8 is a schematic bottom view of a main part of the printing apparatus according to the embodiment of the invention.

As shown in FIG. 8 that is a schematic bottom view of the tray 4 that is a main part of the printing apparatus 1 of the embodiment, the printing apparatus 1 of the embodiment is provided with a protrusion portion 14 on a surface of the tray 4 opposite to the support surface 8. In the base unit 17, a hook portion 15 is formed that suppresses the movement of the tray 4 with respect to the base unit 17 (fixes the tray 4 with respect to the base unit 17) by hooking the protrusion portion 14 when the protrusion portion 14 comes to a predetermined position. Although omitted in FIG. 8, a plurality of protrusion portions 14 and a plurality of hook portions 15 are provided, and a configuration is formed in which the tray 4 can be fixed with respect to the base unit 17 when the tray 4 is moved to each of the base position, the setting position, and the pushed-in position with respect to the base position 17.

As shown in FIG. 8, the hook portion 15 can move in the direction B by an elastic body (a spring). A force that fixes the tray 4 with respect to the base unit 17 by the spring is set so that the tray 4 slides with respect to the base unit 17 when a user applies a strong force in the moving direction A but the tray 4 does not slide with respect to the base unit 17 when the user applies only a small force in the moving direction A. A contact angle of a contact surface of the hook portion 15 with respect to the protrusion portion 14 is set to an angle where the tray 4 is moved by applying only a small force when fixing the tray 4 at a fixed position (when the tray 4 is moved from a position between the base position and the setting position to the base position or the setting position and when the tray 4 is moved from a position between the base position and the pushed-in position to the base position or the pushed-in position) and tray 4 is not moved from the fixed position unless a strong force is applied.

Next, an electrical configuration of the printing apparatus 1 of the embodiment will be described.

Figure 9:
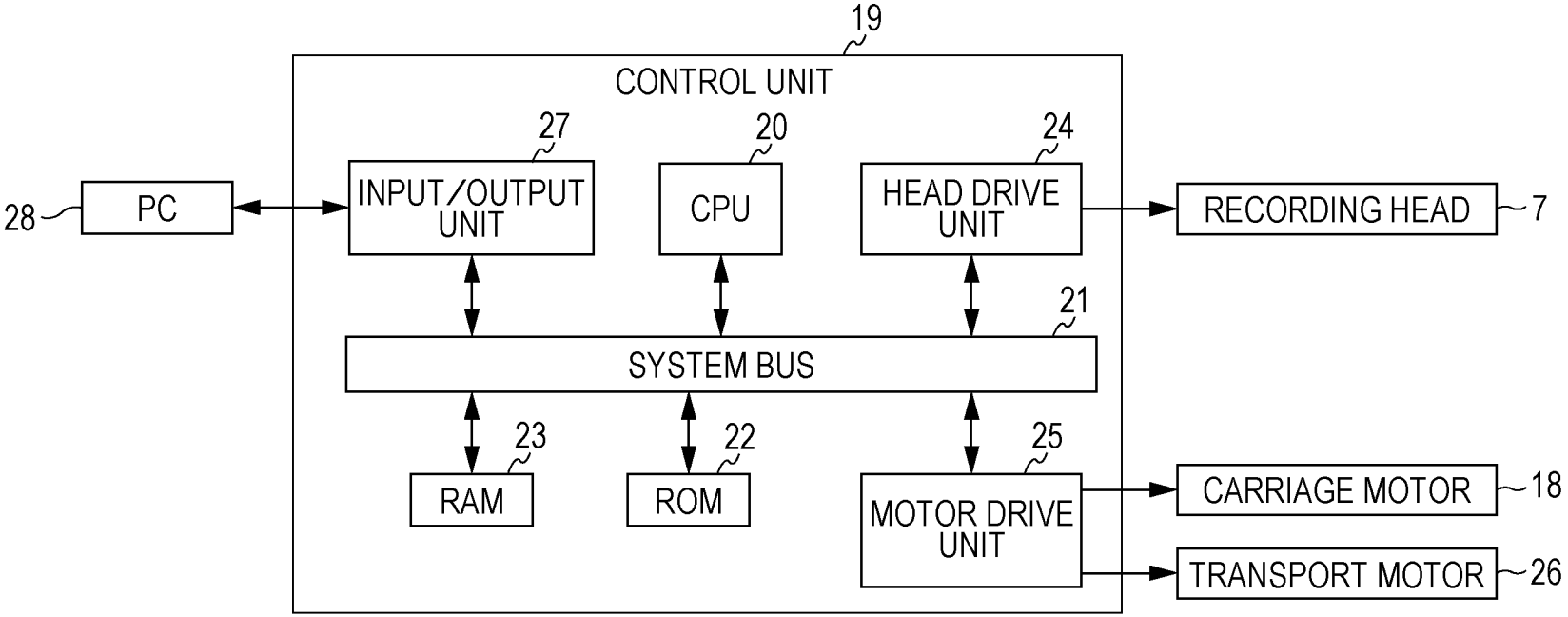
FIG. 9 is a block diagram of the printing apparatus according to the embodiment of the invention.

FIG. 9 is a block diagram of the printing apparatus 1 of the embodiment.

A control unit 19 is provided with a CPU 20 that controls the entire printing apparatus 1. The CPU 20 is connected to a ROM 22 that stores various control programs executed by the CPU 20 and a RAM 23 that can temporarily store data through a system bus 21.

The CPU 20 is also connected to a head drive unit 24 for driving a print head 7 (for causing the print head 7 to discharge ink) through the system bus 21.

The CPU 20 is also connected to a motor drive unit 25 through the system bus 21. The motor drive unit 25 is connected to a carriage motor 18 that moves the carriage 6 and a transport motor 26 provided in the medium transport unit 3 to transport a medium (that is, to move the medium support unit 2).

The CPU 20 is further connected to an input/output unit 27 through the system bus 21. The input/output unit 27 is connected to a PC 28 for transmitting and receiving data such as print data and a signal.

As described above, the printing apparatus 1 of the embodiment includes the base unit 17 that can move in the moving direction A and the tray 4 that supports a medium on which printing will be performed and moves in the moving direction A along with the base unit 17 by being attached to the base unit 17. When the position of the tray 4 with respect to the base unit 17 during printing is defined as the base position, as shown in FIGS. 5 and 6, the tray 4 is slidable with respect to the base unit 17 from the base position in the moving direction A. In other words, the tray 4 moves with respect to the base unit 17 in the moving direction A, so that the tray 4 can move from the base position which is a position during printing to the setting position that is a position of when the medium is set. Specifically, it is possible to move (draw out) the tray 4 to the outside of the housing unit 29 so that the tray 4 is not located inside the housing unit 29 by moving the tray 4 with respect to the base unit 17 in the moving direction A when setting a medium. Therefore, the printing apparatus 1 of the embodiment can suppress deterioration of work efficiency when setting a medium.

Although the configuration of the "base unit" is not particularly limited, when considering that the base unit includes the medium support unit such as the tray 4 of the embodiment, a configuration may be formed which cannot produce an effect that the medium support unit is moved to the outside of the housing unit 29 by moving the medium support unit with respect to the base unit in the moving direction when setting a medium. Therefore, it may be defined that the base unit does not include the medium support unit.

Although the configuration of the "slidable" is not particularly limited, for example, when considering a configuration in which the medium support unit is attached to any position with respect to the base unit or the like, a configuration may be formed which cannot produce an effect that the medium support unit is moved to the outside of the housing unit 29 by moving the medium support unit with respect to the base unit in the moving direction when setting a medium. Therefore, the configuration in which the medium support unit is attached to any position with respect to the base unit or the like may be excluded from a slidable configuration of the invention.

As shown in FIG. 4, the slide mechanism of the embodiment is configured by the slide rails 10 including the upper rails 10*a* and the lower rails 10*b*. However, the slide mechanism is not limited to such a configuration. For example, the slide mechanism may be configured by a groove portion that extends in the moving direction A and a protrusion portion that fits into the groove portion.

In another expression, the invention is a method of moving the medium support unit (the tray 4) in the printing apparatus 1 including the base unit 17 that can move in the moving direction A and the tray 4 that supports a medium on which printing will be performed and moves in the moving direction A along with the base unit 17 by being attached to the base unit 17. When the position of the tray 4 with respect to the base unit 17 during printing is defined as the base position, the tray 4 is slid with respect to the base unit 17 from the base position in the moving direction A. In other words, the tray 4 is moved with respect to the base unit 17 in the moving direction A, so that the tray 4 is moved from the base position which is a position during printing to the setting position that is a position of when a medium is set. Specifically, it is possible to move (draw out) the tray 4 to the outside of the housing unit 29 so that the tray 4 is not located inside the housing unit 29 by moving the tray 4 with respect to the base unit 17 in the moving direction A when setting a medium. Therefore, it is possible to suppress deterioration of work efficiency when setting a medium.

Here, as described above, the printing apparatus 1 of the embodiment includes the carriage 6 that can print an image on a medium and the housing unit 29 that houses the carriage 6 and has the opening portion 13 through which the tray 4 can move forward and backward on one side (in the direction A2) of the moving direction A. As shown in FIG. 5, when the tray 4 is located at the base position in a state in which the base unit 17 is moved most to one side, a part of the tray 4 is located inside the housing unit 29 and the remaining part is located outside the housing unit 29. In other words, at least a part of the tray 4 is located inside the housing unit 29 with respect to the opening portion 13. Specifically, as shown in FIG. 6, while the enlargement of the apparatus is suppressed by reducing the moving range of the base unit 17, the tray 4 is moved with respect to the base unit 17 in the moving direction A in a state in which the base unit 17 is moved most to the one side, and thereby it is possible to move the tray 4 to the outside of the housing unit 29 so that the tray 4 is not located inside the housing unit 29. Therefore, it is possible to suppress deterioration of work efficiency when setting a medium.

Here, "has the opening portion 13 . . . on one side of the moving direction A" has a meaning of having the opening portion 13 at least on one side of the moving direction A, and has a meaning of two cases including a case in which the opening portion 13 is included only on one side of the moving direction A (for example, in the direction A2) and a case in which the opening portion 13 is included on both sides of the moving direction A (in the direction A1 and in the direction A2).

As described above, in the printing apparatus 1 of the embodiment, when the tray 4 is slid from the base position in a state in which the base unit 17 is moved most to one side (the tray 4 is moved from a state shown in FIG. 5 to a state shown in FIG. 6), a part of the tray 4 located inside the housing unit 29 is exposed outside the housing unit 29. In other words, when the tray 4 is located at the setting position in a state in which the base unit 17 is moved most to one side (the state shown in FIG. 6), the tray 4 is located outside the housing unit 29 with respect to the opening portion 13. Therefore, it is possible to suppress deterioration of work efficiency when setting a medium.

As described above, in the printing apparatus 1 of the embodiment, when the tray 4 is located at the base position in a state in which the base unit 17 is moved most to one side (the state shown in FIG. 5), at least a part of the tray 4 is located outside the housing unit 29 with respect to the opening portion 13. As shown in FIG. 5, when the tray 4 is slid from the base position to the other side (in the direction A1) in a state in which the base unit 17 is moved most to one side, as shown in FIG. 7, at least a part of the tray 4 that has been located outside the housing unit 29 is housed inside the housing unit 29. In other words, the tray 4 can move from the base position to the pushed-in position opposite to the setting position in the moving direction A. Therefore, by moving the tray 4 to the pushed-in position when the printing apparatus 1 is not used, it is possible to prevent the tray 4 from being an obstacle. Further, by setting the pushed-in position so that the tray 4 is positioned inside the housing unit 29, it is possible to prevent the tray 4 from getting dirty.

As shown in FIG. 8, the printing apparatus 1 of the embodiment includes a fixing portion (the protrusion portion 14 and the hook portion 15) that fixes the tray 4 to the base unit 17 at the base position. Therefore, it is possible to prevent printing precision from deteriorating due to movement (and vibration) of the tray 4 during printing. As described above, in the printing apparatus 1 of the embodiment, the fixing portion including the protrusion portion 14 and the hook portion 15 can fix the tray 4 to the base unit 17 at the setting position and the pushed-in position in addition to the base position.

As shown in FIG. 8, the fixing portion of the embodiment is a fixing portion configured by the protrusion portion 14 and the hook portion 15. However, the configuration of the fixing portion is not limited to the above configuration. For example, the fixing portion may fix the tray 4 by screwing.

A holding portion that can be held when the tray 4 is moved with respect to the base unit 17 in the moving direction A may be provided to the tray 4. This is because it is possible to improve workability when moving the tray 4 with respect to the base unit 17 in the moving direction A.

Further, by forming a configuration in which the tray 4 is unfixed from the base unit 17 by holding the holding portion and the tray 4 is fixed to the base unit 17 by releasing hand from the holding portion (by stopping the holding), it is possible to improve workability particularly when moving the tray 4 with respect to the base unit 17 in the moving direction A.

The invention is not limited to the above embodiment and it is needless to say that the invention can be variously modified within the scope of the invention described in the claims and the various modifications are also included in the scope of the invention.

For example, it is possible to move the tray 4 with respect to the base unit by using a drive source such as a motor. When the tray 4 is moved with respect to the base unit by the drive source, it is possible to reduce the load of a user and it is possible to further suppress deterioration of work efficiency when setting a medium. In this configuration, the tray 4 may be moved with respect to the base unit 17 by the drive source while the tray 4 is moving along with the base unit 17 (while printing is being performed). By doing so, two types of movements are performed at the same time, so that it is possible to improve throughput. When the tray 4 is moved with respect to the base unit 17 by the drive source while the tray 4 is moving along with the base unit 17 (while printing is being performed), it is possible to set the moving range of the base unit 1 to be shorter, so that it is possible to further reduce the depth length L1 of the printing apparatus 1.

This application claims priority under 35 U.S.C. § 119 to Japanese Patent Application No. 2015-221210, filed Nov. 11, 2015. The entire disclosure of Japanese Patent Application No. 2015-221210 is hereby incorporated herein by reference.

What is claimed is:

1. A printing apparatus comprising:

a base unit that can move in a moving direction; and a medium support unit that supports a medium on which printing will be performed and moves in the moving direction along with the base unit by being attached to the base unit, wherein when a position of the medium support unit with respect to the base unit during printing is defined as a base position, the medium support unit is slidable with respect to the base unit from the base position in the moving direction such that the medium support unit is slidable from the base position when supporting the medium, and wherein when the medium support unit is located at the base position, the base unit is configured to not directly support the medium by covering the entire base unit with the medium support unit.

2. The printing apparatus according to claim 1, further comprising:

a printing unit that can print an image on the medium; and a housing unit that houses the printing unit and has an opening portion through which the medium support unit can move forward and backward on one side of the moving direction, wherein when the medium support unit is located at the base position in a state in which the base unit is moved most to the one side, at least a part of the medium support unit is located inside the housing unit with respect to the opening portion.

3. The printing apparatus according to claim 2, wherein when the medium support unit is slid from the base position in a state in which the base unit is moved most to the one side, a part of the medium support unit that was located inside the housing unit is exposed to outside of the housing unit.

4. The printing apparatus according to claim 2, wherein when the medium support unit is located at the base position in a state in which the base unit is moved most to the one side, at least a part of the medium support unit is located outside the housing unit with respect to the opening portion, and when the medium support unit is slid from the base position to the other side in a state in which the base unit is moved most to the one side, at least a part of the part that was located outside the housing unit is moved to be housed inside the housing unit.

5. The printing apparatus according to claim 1, further comprising:

a fixing portion that fixes the medium support unit to the base unit at the base position.

6. The printing apparatus according to claim 1, wherein the medium support unit includes a holding portion that can be held when the medium support unit is moved with respect to the base unit in the moving direction.

7. The printing apparatus according to claim 1, further comprising:

slide rails provided between the medium support unit and the base unit, wherein the medium support unit is configured to be able to slide with respect to the base unit by sliding the slide rails.

8. The printing apparatus according to claim 7, wherein the slide rails include an upper rail and a lower rail, and the medium support unit is configured to be able to slide with respect to the base unit by sliding on the upper rail with respect to the lower rail.

9. A method of moving a medium support unit in a printing apparatus including a base unit that can move in a moving direction and a medium support unit that supports a medium on which printing will be performed and moves in the moving direction along with the base unit by being attached to the base unit, the method comprising:

sliding the medium support unit with respect to the base unit from a base position in the moving direction when a position of the medium support unit with respect to the base unit during printing is defined as the base position such that the medium support unit is slidable from the base position when supporting the medium, and covering the entire base unit with the medium support unit by setting the medium support unit at the base position such that the base unit is configured to not directly support the medium.

* * * * *